United States Patent [19]

Hightower

[11] 4,317,494

[45] Mar. 2, 1982

[54] MATERIAL REMOVAL DEVICE

[75] Inventor: Arthur A. Hightower, Olmsted Falls, Ohio

[73] Assignee: Lee Turzillo Contracting Company, Richfield, Ohio

[21] Appl. No.: 148,514

[22] Filed: May 9, 1980

[51] Int. Cl.[3] ..... E02B 17/144

[52] U.S. Cl. ..... 175/88; 175/209

[58] Field of Search ..... 175/84, 88, 209, 57, 175/161

[56] References Cited

U.S. PATENT DOCUMENTS

| | | | |
|---|---|---|---|
| 862,406 | 8/1907 | Livermore | 175/209 |
| 978,699 | 12/1910 | Coleman | 175/88 |
| 3,556,232 | 1/1971 | Kozinski | 175/88 |
| 3,894,400 | 7/1975 | Stillwell | 175/88 |
| 4,025,119 | 5/1977 | Watts | 175/88 |
| 4,057,117 | 11/1977 | Bemingham | 175/88 |

*Primary Examiner*—William F. Pate, III

*Attorney, Agent, or Firm*—Baldwin, Egan, Walling & Fetzer

[57] ABSTRACT

A material removal device for removing auger spoil from a drilling site (such as, for example, an earth situs). A hollow spoil-receiving container is provided having an inclined floor and having a generally vertically disposed barrel portion secured to the inclined floor adjacent the upper end thereof for enclosing a preselected axial length portion of the auger with a snug operable fit. The auger is operably movable in the container barrel portion during drilling to permit the spoil from the drilling operation to be carried upwardly through the barrel portion by the auger flights and deposited in the main part of the container. The container also has a selectively lockable door vertically hinged on the container at a point adjacent the lower end of the container inclined floor. A generally vertically disposed elongated framework structure is secured to the container and extends upwardly therefrom. The framework structure has auger drive means and auger guide means theron for operating and guiding the auger during the drilling operation.

In operation, the auger draws spoil up the container barrel portion and thence into the main portion of the container where it is temporarily stored. A derrick is provided for lifting the auger and the container and framework structure as a unit from the drilling site over to a dumping site where the container door may be opened to dump the spoil from the container.

1 Claim, 8 Drawing Figures

MATERIAL REMOVAL DEVICE

This invention relates to an auger spoil removal device, and more particularly to such a device for removing auger spoil from the drilling site to a remote dumping site.

BACKGROUND OF THE INVENTION

In the construction of concrete piles and other like structures, it is common practice to use an auger to drill a hole of the requisite diameter and depth. During drilling of any such hole using an auger, the dirt or other spoil is carried upwardly out of the hole by the flights on the outer wall of the auger stem. The spoil from the hole is deposited on the ground around the periphery of the hole and must ordinarily be removed to prevent the spoil from being subsequently picked up by the auger flights or falling back into the hole after the auger has been removed therefrom. The deposits of spoil around the hole are also usually removed so as not to interfere with any subsequent work which may have to be performed at the hole site.

Consequently, it has been the usual practice to position one or two workmen adjacent the foot of the drill rig whose job it is to remove the spoil from adjacent the top of the hole as the spoil is carried upwardly out of the hole by the auger flights. It is of course very costly to use skilled or semi-skilled labor for this purpose, and there is also some risk of injury to the workmen doing this work.

Therefore, it is an object of the invention to provide a material removal device that removes auger spoil from a drilling site to a dump site without hand labor.

A further object is to provide a device of the above type having a spoil-receiving container enclosing the auger wherein the auger and container are removed as a unit from the drilling site to a dump site.

A further object is to provide a method of removing auger spoil from a drilling site wherein the drilling and depositing of the auger spoil in a container is effected simultaneously, after which the auger and container are lifted as a unit to a dump site.

A further object is to provide such a material removal device which readily permits depositing of the spoil picked up by the auger flights during drilling at different spaced locations from the hole.

A further object is to provide such a material removal device which is maintained in proper alignment with the auger and mounted for ease of movement therewith from one hole location to another.

A further object is to provide a material removal device of the above type that is simple in construction, inexpensive to manufacture, and highly effective in operation.

BRIEF DESCRIPTION OF THE INVENTION

Briefly, the foregoing objects are accomplished by the provision of a material removal device for removing spoil from the flights of an auger including a hollow spoil-receiving container having an inclined floor and a generally vertically-disposed barrel portion secured to the inclined floor adjacent the upper end thereof (and extending downwardly therefrom) for enclosing a preselected axial length portion of the auger with a snug operable fit. The auger is operably movable in the container barrel portion during drilling to permit spoil from the drilling operation to be carried upwardly through the barrel portion by the auger flights and deposited in the main part of the container. The container also has a selectively lockable door vertically hinged on the container at a point adjacent the lower end of the inclined floor. A generally vertically disposed elongated framework structure is provided which is secured to the container and extends upwardly therefrom. Such framework structure includes auger drive means and auger guide means thereon for operating and guiding the auger during the drilling operation.

In operation, the auger draws spoil up the barrel portion and thence into the container main portion from which it may be selectively removed by opening the container door. A derrick is provided for lifting the auger and the container and framework structure as a unit from a drilling site to a dumping site where the door may be opened to dump the spoil from the container.

Other objects and advantages of the invention will be apparent from the following description taken in conjunction with the drawings wherein:

BRIEF DESCRIPTION OF THE DRAWINGS

In the drawings, like numbers and letters are used to identify like and similar parts throughout the several views.

Figure 1:
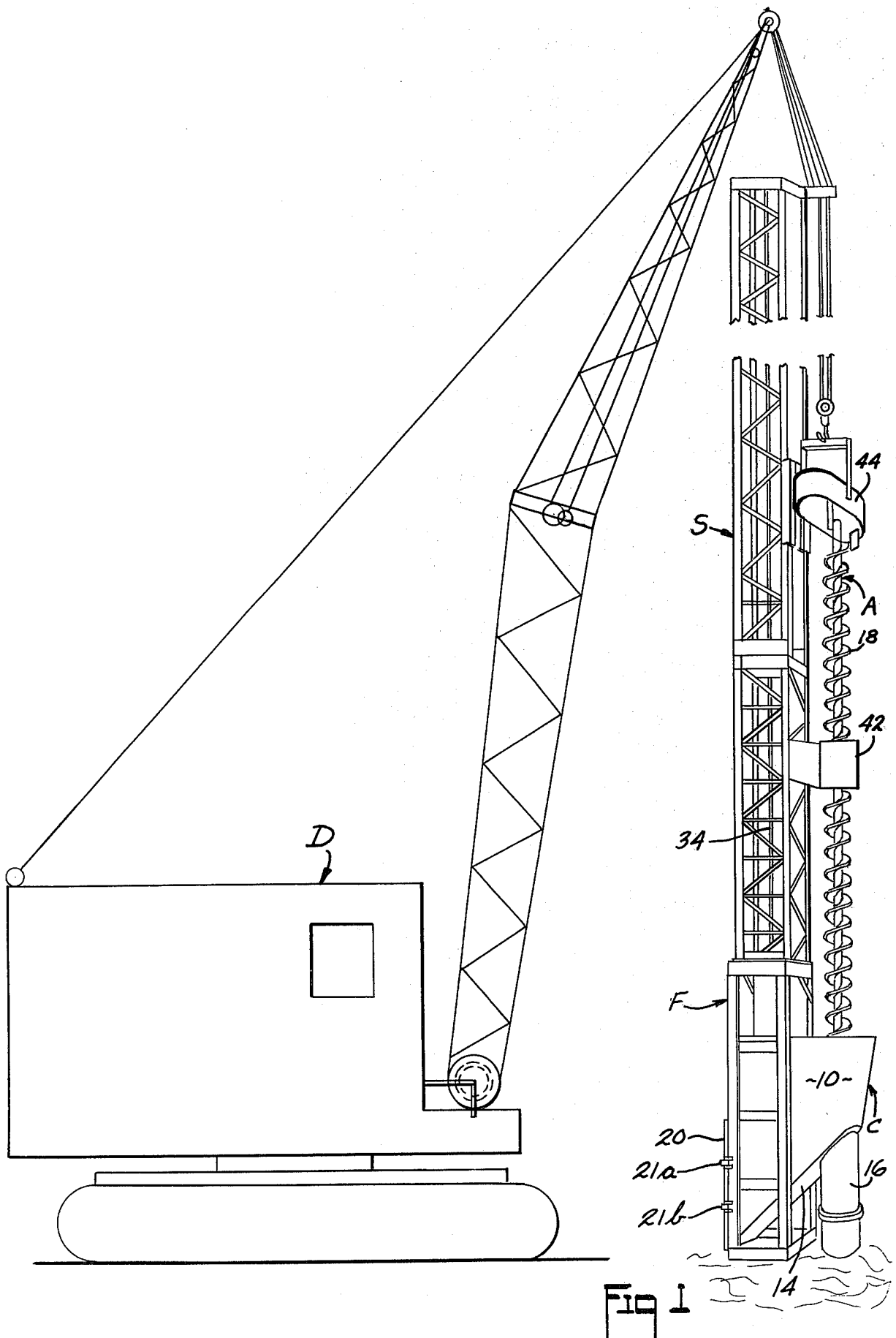
FIG. 1 is a perspective view of a material removal device assembly constructed in accordance with the invention.

Referring first to FIG. 1, there is shown a material removal device assembly of the invention and including, as main components, the hollow spoil-receiving container C, the drill or auger A, the container and drill supporting framework structure S, and the hoist means or derrick D for selectively lifting the components C, A and S and positioning them on a drilling (or dumping) site.

Figure 2:
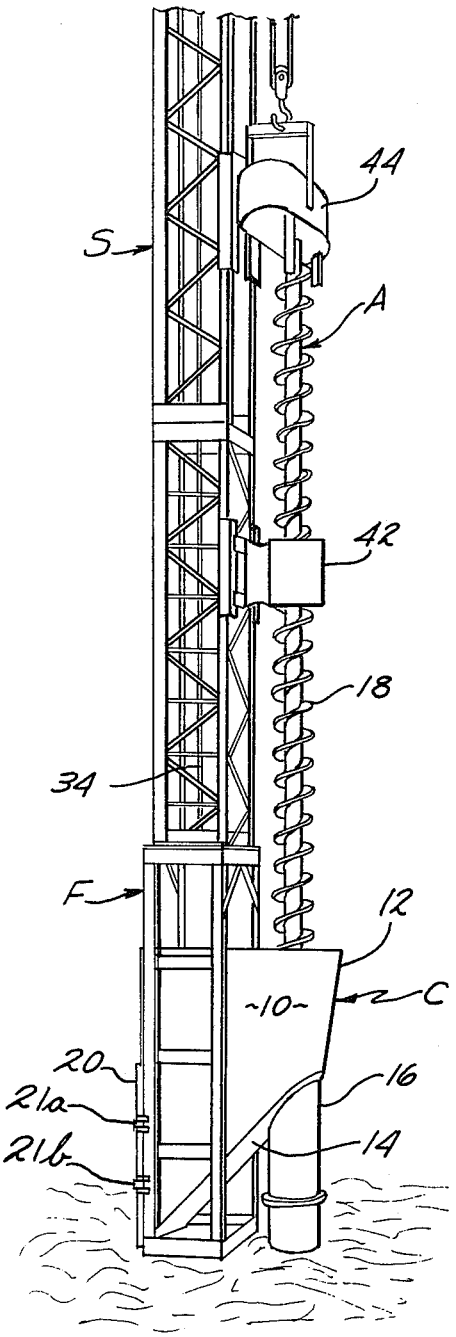
FIG. 2 is a portional, perspective view of the container drill and framework structure portion of the assembly shown in FIG. 1.
Figure 3:
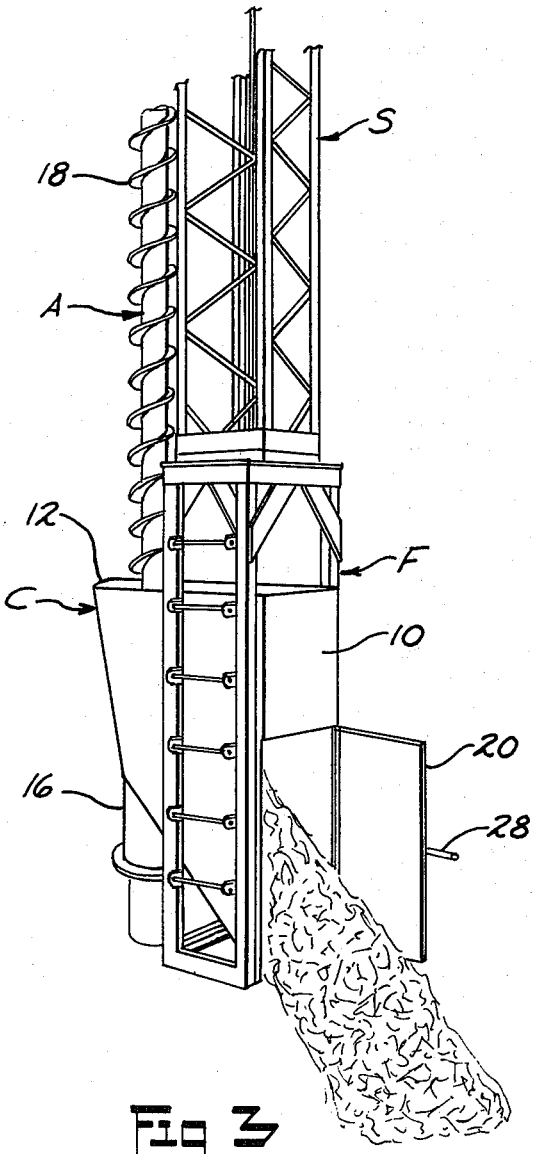
FIG. 3 is an enlarged, portional, perspective front view of the lower portion of the apparatus shown in FIG. 2, and showing the dumping door open.
Figure 4:
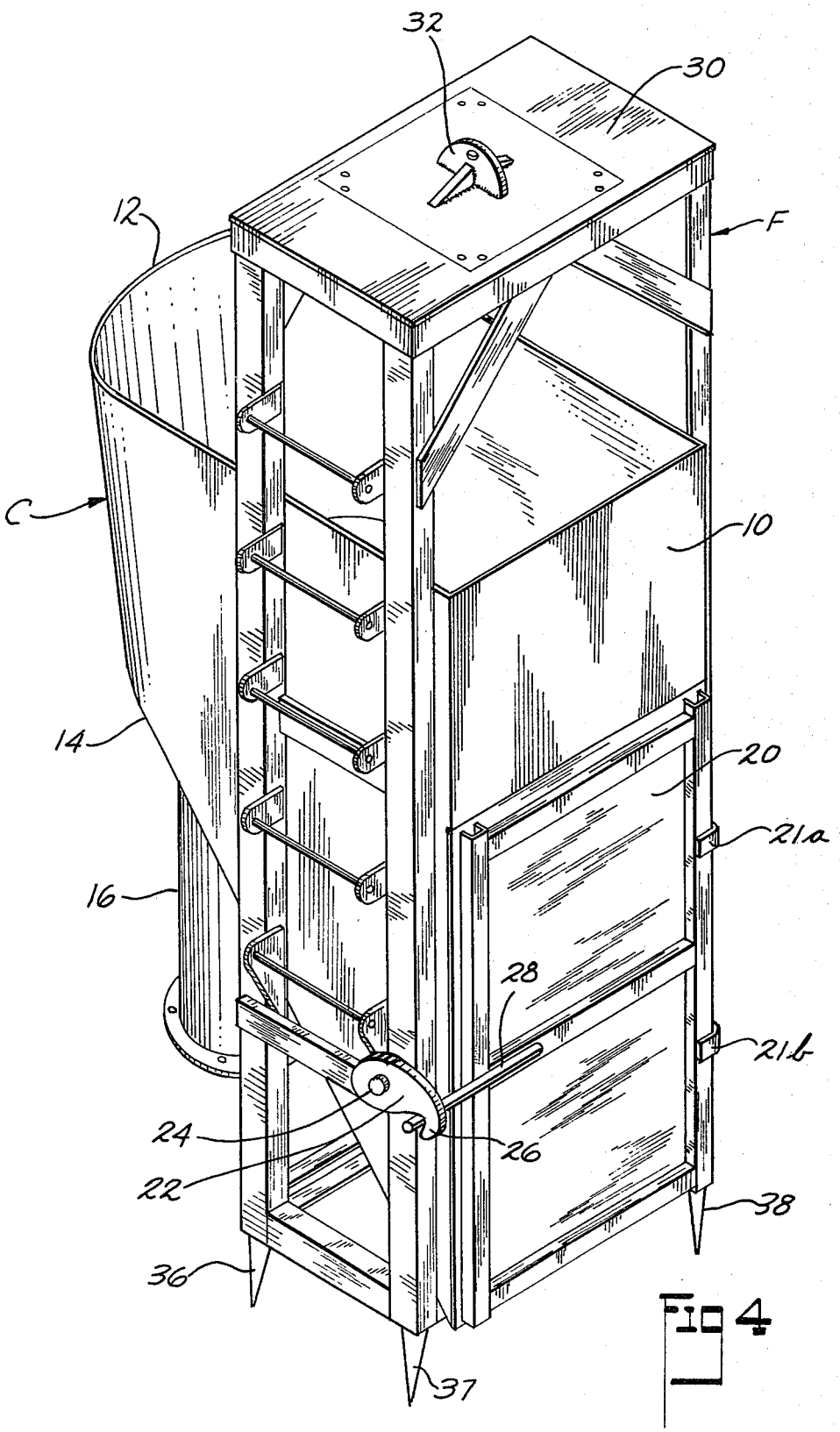
FIG. 4 is an enlarged, perspective, front view of the container shown in FIG. 3, but showing the dumping door closed.
Figure 6:
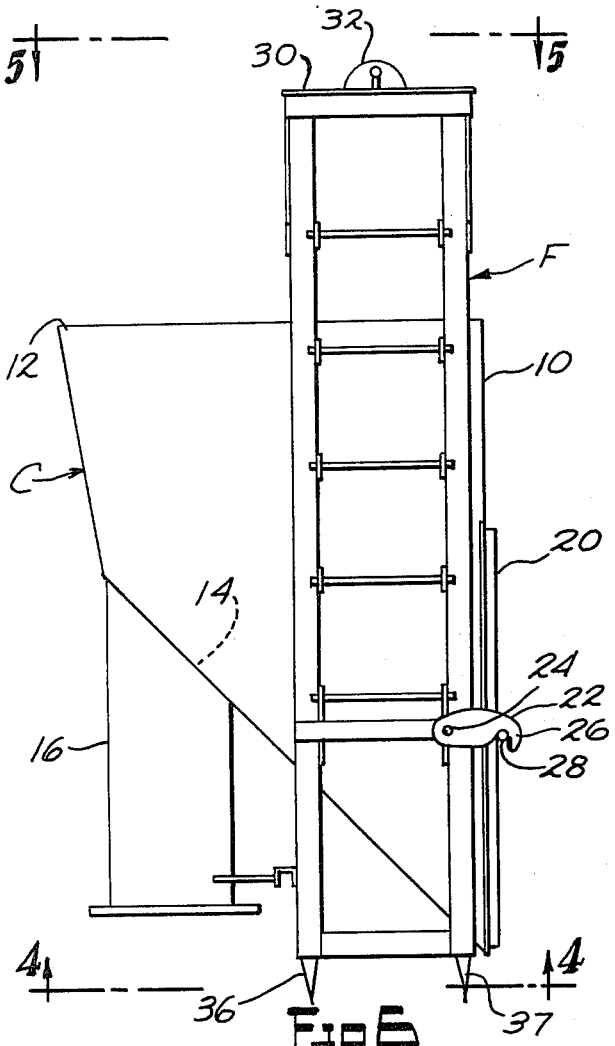
FIG. 6 is a left side elevational view of the container shown in FIG. 5.
Figure 5:
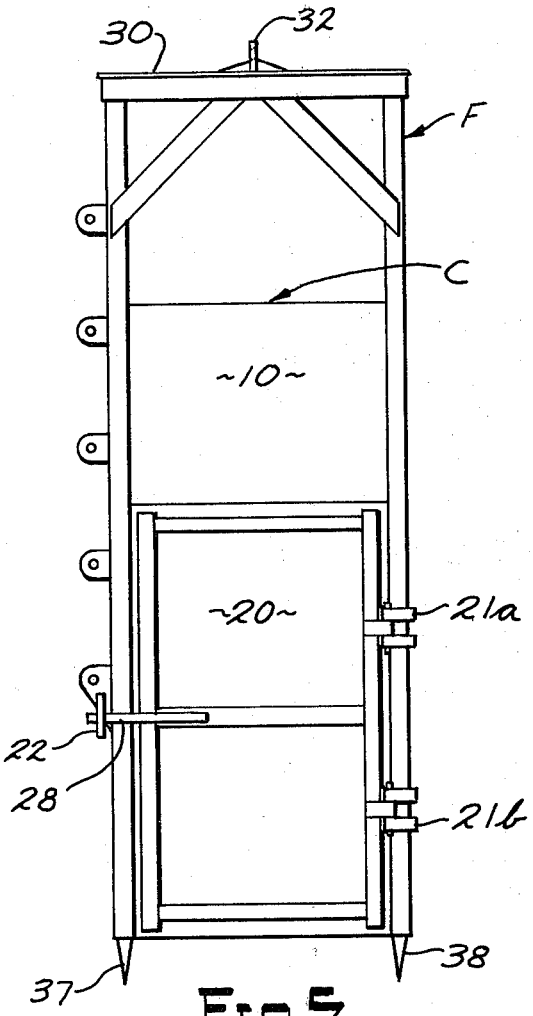
FIG. 5 is a reduced front elevational view of the container shown in FIG. 4.
Figure 7:
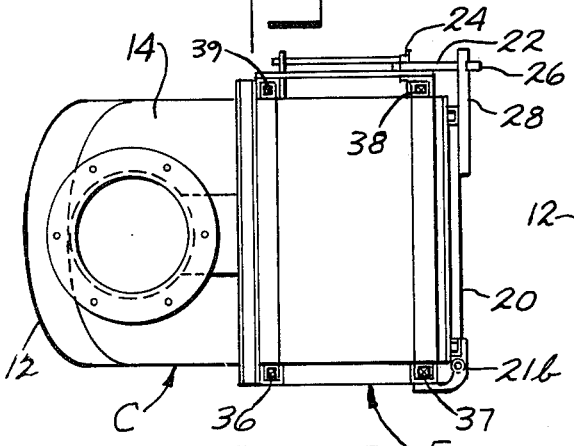
FIG. 7 is a bottom view of the container shown in FIG. 5.
Figure 8:
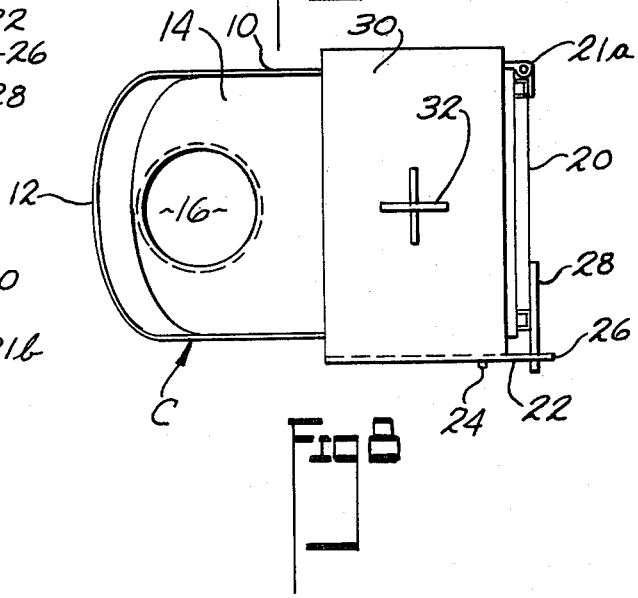
FIG. 8 is a top plan view of the container shown in FIG. 5.

The container C (FIGS. 2–8) includes a hollow tub portion 10, open at the top, and having a rounded rear portion 12. The container C also includes an inclined floor 14 (FIG. 2) and a generally vertically disposed barrel portion 16 secured to the inclined floor 14 adjacent the upper end thereof for enclosing a preselected axial length portion of the auger A with a snug operable fit, as best shown in FIGS. 1, 2 and 3. The auger A is selectively longitudinally (and circumferentially) movable through the container barrel portion 16 during drilling to permit the spoil from the drilling operation to be carried upwardly through the barrel portion 16 by auger flights 18 and deposited in the container tub portion 10.

The container C also has an emptying means in the form of a selectively blockable door 20 vertically hinged by hinges 21*a* and 21*b* on the container C at a point adjacent the lower end of the inclined floor 14. The door 20 has a releasably lockable lock pawl 22 hinged at 24 with a hook portion 26 which releasably engages the door bar 28 to selectively lock the door 20 on the container C.

The container C includes and is contained in a box-like rectangular frame F (FIG. 4) which functions to structurally support the container C. The frame F includes a top plate 30 having a hook attachment 32 thereon to which the derrick cable 34 (FIG. 2) is attached, whereby the frame F and the container C may be hoisted as a unit and positioned over a drilling site. When the container C is filled with spoil, the entire unit may then be hoisted and removed to a dumping site. The frame F is provided with earth anchoring spikes 36, 37, 38 and 39 (FIGS. 4 and 7) enabling firm securement of the entire assembly at a drilling site for drilling purposes. As aforementioned, the door 20 has a releasably lockable lock pawl 22 hinged at 24 with a hook portion 26 which releasably engages the door bar 28 to selectively lock the door 20 on the container C in preparation for receiving drilling spoil.

The frame F is rigidly secured to the framework structure S as best shown in FIG. 1. The structure S functions as an auger control means to operatively support and drive the auger A by means of the auger guide means 42 and the auger drive means 44, and also functions as an intermediate frame for the container C (between the container C and the derrick D).

In operation, the entire unit consisting of the container C, the frame F, the framework structure S and the auger A, are lifted as a complete assembly and placed on a drilling site whereby the spikes 36, 37, 38 and 39 are embedded in the ground to thus firmly anchor the assembly at such site. The auger A then draws spoil up the barrel portion 16 and thence into the container C. When the container C is filled with spoil, the assembly is then hoisted over to a dump site where the door 20 is opened and the spoil is thus removed from the container C as best shown in FIG. 3.

Thus, the invention provides a device for selectively holding spoil from an auger including a hollow container C for enclosing an axial length portion of an associated auger A with a snug operable fit, such container C having emptying means 20 on its lower portion selectively operable to empty spoil from the container. The invention further includes hoist means D for lifting the container C and associated auger A as a unit to an associated dump site to dump the spoil thereat. Also provided is a generally vertically disposed elongated framework structure S secured to the container C and extending upwardly therefrom, such framework structure S having auger drive means 44 and auger guide means 42 thereon for operating and guiding the auger A during the drilling operation.

The invention also contemplates a method for removing auger spoil from a drilling site including, drilling a hole with an auger A, depositing the drilled spoil in a container C which encloses the auger A, and removing the auger A and container C with spoil therein as a unit to a dump site.

In more detail, there is provided a method for removing auger spoil from a drilling site including, drilling a hole with an auger A and coactingly depositing the auger spoil directly into a container C which encloses the auger A, lifting the auger A and container C as a unit over to a dump site, and dumping the spoil from the container C at the dump site.

In further detail there is provided a method for removing auger spoil from a drilling site including, providing an auger A having a container C enclosing a preselected axial length portion of the auger A with a snug operable fit, drilling a hole at an earth site with the auger A and coactingly depositing the auger spoil directly into the container A, providing the container C with a spoil emptying door 20, lifting the auger A and container C as a unit to a dump site, and opening the container door 20 to dump the spoil from the container C at the dump site.

In further detail there is provided a method for removing auger spoil from an auger drilling site including, providing an auger A having a container C with a barrel portion 16 enclosing a preselected axial length portion of the auger A with a snug operable fit, providing the container C with a selectively lockable spoil emptying door 20 vertically hinged on the container C, drilling a hole at an earth site with the auger A and coactingly depositing the auger spoil directly into the container C, lifting the auger A and container C as a unit to a dump site, and opening said container door 20 to dump the spoil from the container C at the dump site.

The terms and expressions which have been employed are used as terms of description, and not of limitation, and there is no intention, in the use of such terms and expressions, of excluding any equivalents of the features shown and described or portions thereof, but it is recognized that various modifications are possible within the scope of the invention claimed.

What is claimed is:

1. A material removal device for removing spoil from the flights of an auger comprising, an auger having flights thereon, a frame, a hollow spoil receiving container secured in said frame and having a container inclined floor, said container having a rounded rear portion having a rear portion inclined floor which forms an extension of said container inclined floor, a generally vertically disposed barrel portion secured to the rear portion inclined floor adjacent the upper end thereof for enclosing a preselected axial length portion of said auger with a snug operable fit, said auger being selectively longitudinally movable through the container barrel portion during drilling to permit the spoil from the drilling operation to be carried upwardly through the barrel portion by the auger flights and deposited in the container, said container also having a selectively lockable door vertically hinged on said container at a point adjacent the lower end of said inclined floor, said door and frame having a releasable door lock thereon, said frame having a plurality of downwardly extending spikes on its lower end enabling firm securement of the device during drilling, a generally vertically disposed elongated framework structure secured to said container and extending upwardly therefrom, said framework structure having auger drive means and auger guide means thereon for operating and guiding said auger during the drilling operation, whereby in operation the auger draws spoil up the barrel portion and thence into the container from which it may be selectively removed via said door, and a derrick for lifting said auger and said container and framework structure as a unit from a drilling site to a dumping site where said door may be opened to dump spoil from the container.

* * * * *